US005996973A

United States Patent [19]

Campbell

[11] Patent Number: 5,996,973

[45] Date of Patent: Dec. 7, 1999

[54] FENCE GATE SUPPORT DEVICE

[76] Inventor: Houston T. Campbell, 116 Creasey Creek Rd., Jonesborough, Tenn. 37659

[21] Appl. No.: 08/970,599

[22] Filed: Nov. 14, 1997

Related U.S. Application Data

[63] Continuation-in-part of application No. 08/746,082, Nov. 6, 1996.

[51] Int. Cl.[6] ..... E04H 17/06

[52] U.S. Cl. ..... 256/35; 256/31; 256/73

[58] Field of Search ..... 256/35, 30, 31, 256/34, 64, 73, 33, 32, 52, 48, 2, 11; 52/146, 149, 150, 151; 403/403

[56] References Cited

U.S. PATENT DOCUMENTS

| | | | |
|---|---|---|---|
| 327,814 | 10/1885 | Montgomery | 256/48 X |
| 560,364 | 5/1896 | Owens | 52/150 |
| 1,210,541 | 1/1917 | Ryker | 256/11 X |
| 2,147,496 | 2/1939 | Nelson | 52/150 |
| 4,078,754 | 3/1978 | Gould | 256/54 X |
| 4,889,322 | 12/1989 | Wagner | 403/403 |
| 5,042,780 | 8/1991 | Yearwood | 256/35 X |
| 5,046,705 | 9/1991 | Williams | 256/56 X |

*Primary Examiner*—Lynne H. Browne
*Assistant Examiner*—John R. Cottingham

[57] ABSTRACT

A fence gate support device which in its broad embodiment comprises a pair of first and second post members which, when driven into the ground and clamped together with upper and lower clamp bars, provide a lateral stabilizing first unit for a gate adapted to hang on gate hinge pins affixed to the clamp bars. A fence line stabilizing second unit is provided and has a third post member having a connector on one end and having its other end adapted to be driven into the ground at a distance of several feet from the first unit generally along the fence line and then bent to an angle appropriate to slide the connector over the top of one of the first or second post members. A locking mechanism is provided on the connector and on the third post member such that the connector cannot slide any substantial distance on the third post member when the locking mechanism is engaged.

18 Claims, 6 Drawing Sheets

FENCE GATE SUPPORT DEVICE

This application is a continuation-in-part of Applicants Ser. No. 08/746,082 filed Nov. 6, 1996 and presently pending.

BACKGROUND OF THE INVENTION

1. Field of the Invention

The present invention pertains to a quickly assembleable fence post bracing structure which provides sufficient vertical support for end posts, corner posts, or gate posts for hanging heavy gates, and in particular, for large paddock type swing gates.

Steel fence posts having a generally T-shaped configuration and having a series of studs vertically spaced along the longitudinal axis are widely used especially for farm use where livestock separation is required. When driven into the ground, these posts provide sufficient support for fencing, however, a driven post alone in a fence end or corner position is unable to support the constant tension of tightly strung fencing, particularly when combined with the weight of a paddock type gate hinged to the post.

2. Prior Art

The prior art identifies several attempts to reinforce fence posts by using, for example, diagonal bracing members. U.S. Pat. No. 5,192,055 teaches a brace assembly used with the aforementioned steel T-shaped post for reinforcing all fence posts as well as gate bearing posts. A multitude of such reinforcement or bracing members are bolted to bracket assemblies which are in turn bolted to each other effectively clamping the fence posts, and ground engaging members. To provide sufficient support for a terminating, i.e., fence end post on which a gate is hung, horizontal braces are bolted to the top and bottom of the terminating post and connected to an adjacent post. It appears that some sort of additional lateral support should be added to the terminating post on which the gate is attached in order to provide reinforcement when the gate is open, however, such is not disclosed. Lateral support such as shown in other examples would provide awkward diagonal reinforcement members protruding from either side of the terminating gate bearing post, which would impede the full range of motion of the gate.

OBJECTS OF THE INVENTION

Objects therefore of the present invention are to provide a stable gate supporting, terminating fence post, or corner post bracing structure which, in a preferred embodiment, allows the use of readily available low cost studded T-shaped fence posts and an easily deployed connecting mechanism; to provide such a structure which, with gate engaged, allows a large, unimpeded radius of movement of the gate; and to provide such a structure which is easily and quickly assembled and can be used as a temporary fencing solution as well as a permanent one for end posts, corner posts or gate hanging posts.

SUMMARY OF THE INVENTION

The above and other objects have been attained in accordance with the present invention through the discovery of a fence post support device which in one of its preferred embodiments for hanging a heavy gate, comprises a pair of first and second post members which, when driven into the ground and clamped together with upper and lower clamp means, provide a lateral stabilizing first unit for a gate adapted to hang on gate hinge pins affixed to the clamp means, wherein a fence line stabilizing second unit is provided and comprises at least one third post member or brace means having a connector means or adapter means on one end and having its other end adapted to be driven into the ground at a distance of several feet from sold first unit generally along the fence line and then bent to an angle appropriate to slide the connector means over the top of one of said first or second post members, and wherein, if desired, a locking mechanism is provided on the connector means and on the third post member such that the connector means cannot slide any substantial distance on the third post member when the locking mechanism is engaged.

BRIEF DESCRIPTION OF THE DRAWINGS

The invention will be further understood from the following drawings of certain preferred embodiments and description wherein certain dimensions are enlarged for clarity.

DETAILED DESCRIPTION OF THE DRAWINGS

Figure 1:
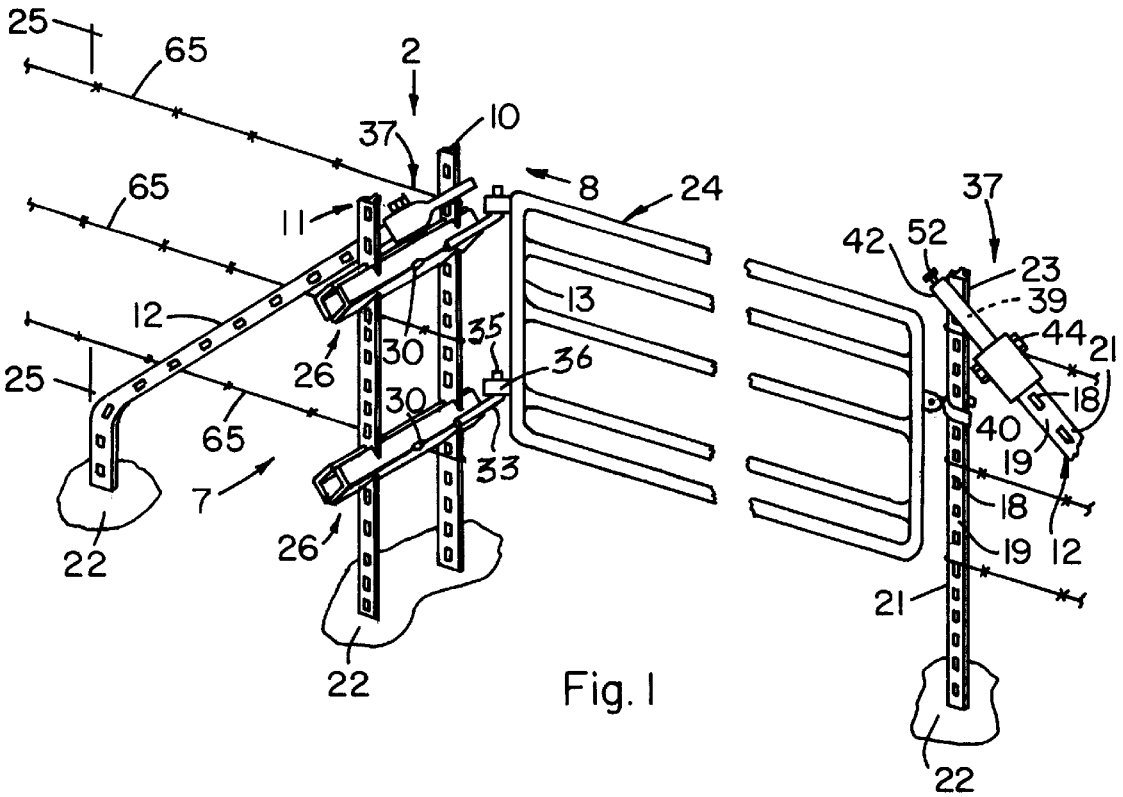
FIG. 1 is a perspective view of preferred embodiments of the present invention showing the structural components in their operating positions supporting a heavy swinging gate and providing fence-line stabilizing support to a terminating fence post.
Figure 2:
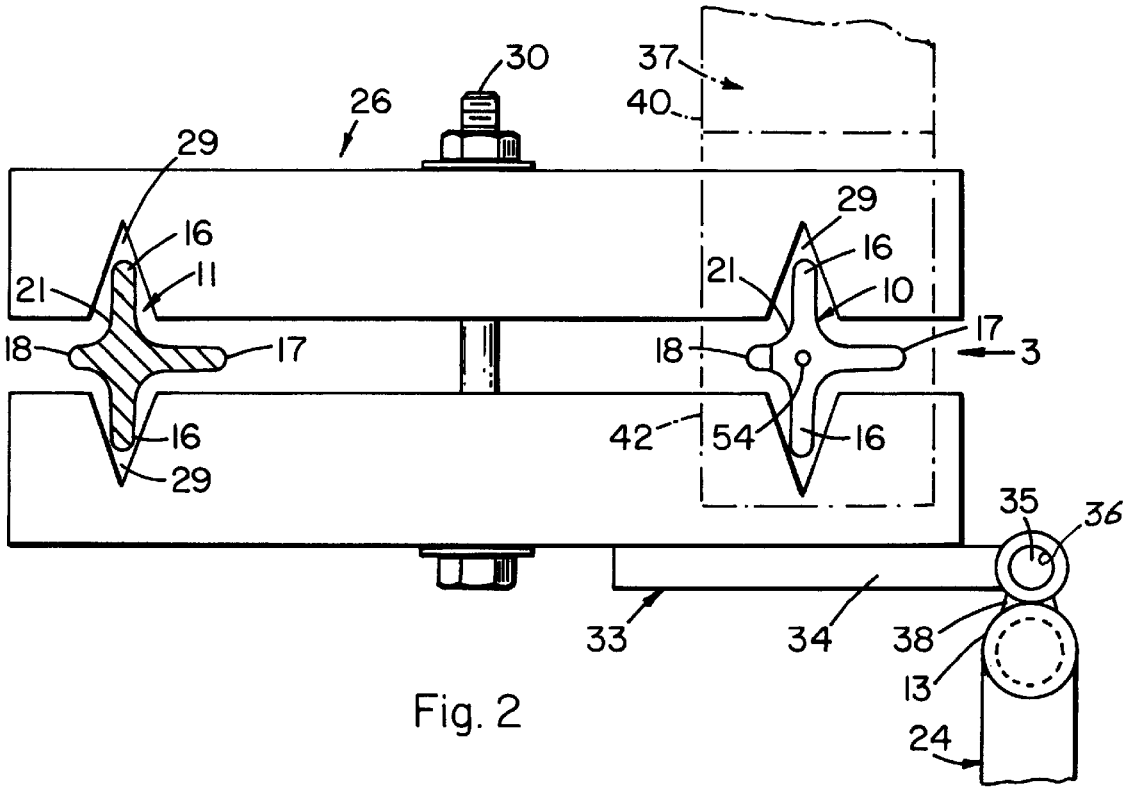
FIG. 2 is a top down view of the clamp bar, clamping bolt, and first and second support posts with a hinge pin and vertical portion of a paddock gate mounted thereon, taken in the general direction of line 2 of FIG. 1 showing the proximity of these components with the clamping bolt untightened and the connector means shown in phantom line for purposes of clarity.
Figure 4:
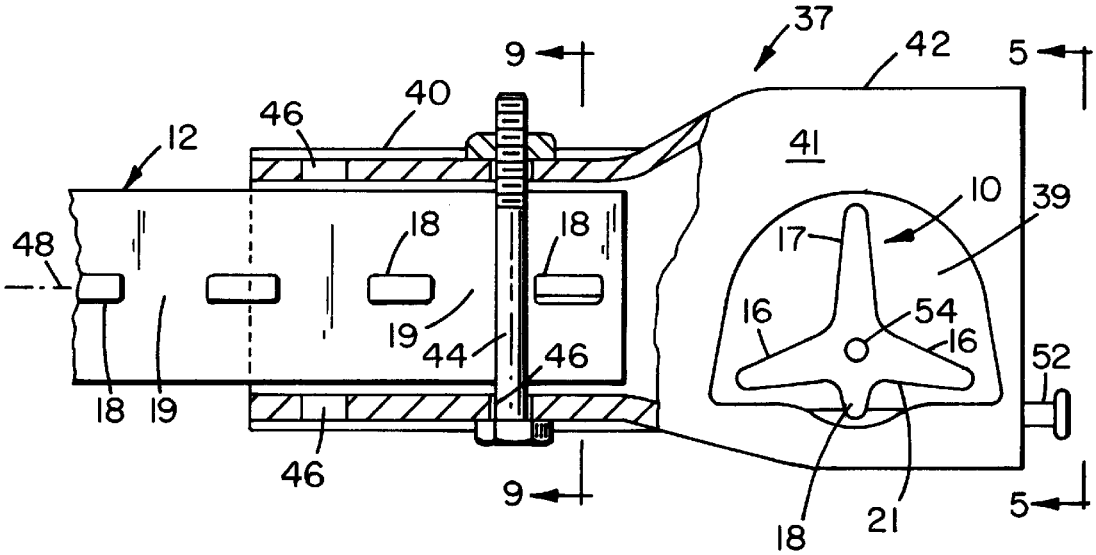
FIG. 4 is a generally top down view as in FIG. 2, partially sectioned and showing the third support post end portion with the connector affixed thereto and to first support post.
Figure 9:
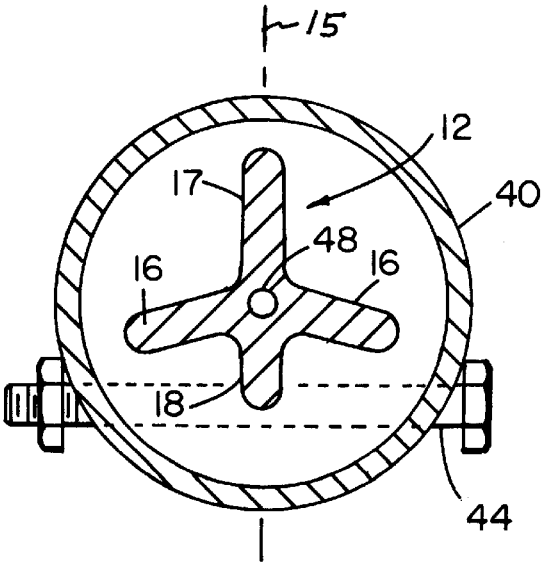
FIG. 9 is a cross-sectional view taken along line 9—9 of FIG. 4 in the direction of the arrows and rotated 90° counterclockwise.
Figure 8:
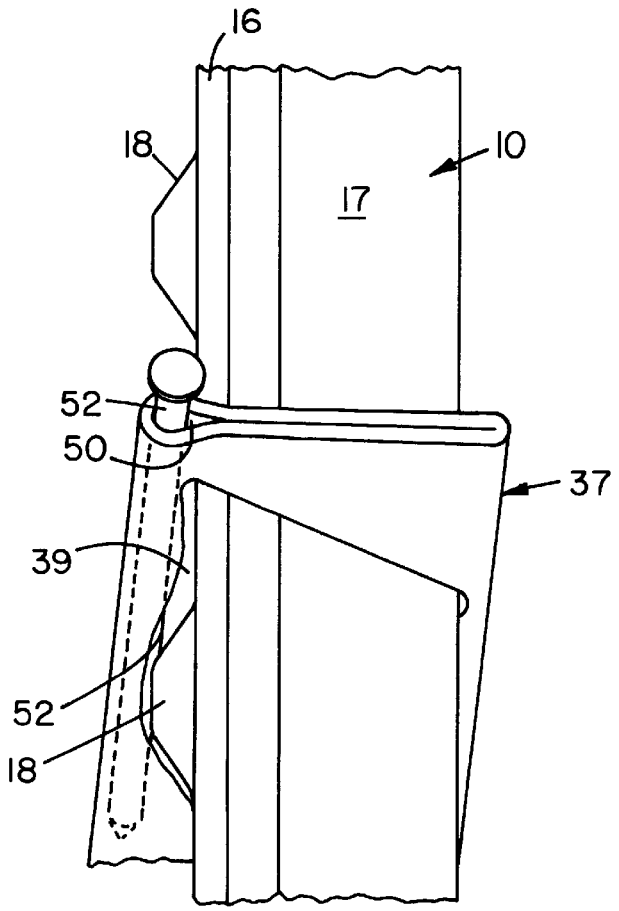
FIG. 8 is a view taken generally in the direction of line 8 in FIG. 1 showing the connector means assembled on the gate support post.

Referring to the drawings and with particular reference to the claims herein, the present device comprises first 10, second 11, and third 12 support means preferably comprised of common, metal, generally T-shaped fence posts as shown isometrically in FIG. 1, and as shown in cross-section in FIGS. 2, 4, and 9 having laterally oriented fins 16, a front fin 17 lying along a spinal axis 15, studs 18 and associated spaces 19 provide substantially along a longitudinal center line 20 of the back face 21 extending the length of the post.

As shown in FIG. 1, the first 10, second 11, and third 12 posts or support members are driven into the ground 22 to a depth as would normally be expected for such a fence supporting member, e.g., 1–2 feet such as that represented by fence post 23. The first support member 10 is shown as the terminating post of the fence and supports the weight of a fence or paddock gate 24 which is shown in FIG. 1 in a closed position. The second support member 11 is driven into the ground, e.g., approximately from about 8 to about 20 inches away from member 10, and when coupled to member 10 provides lateral support to member 10 when the gate is swung to an open position. These two support members lie in a plane generally lateral to the general fencing plane indicated by line 25—25 shown in FIG. 1.

Figure 3:
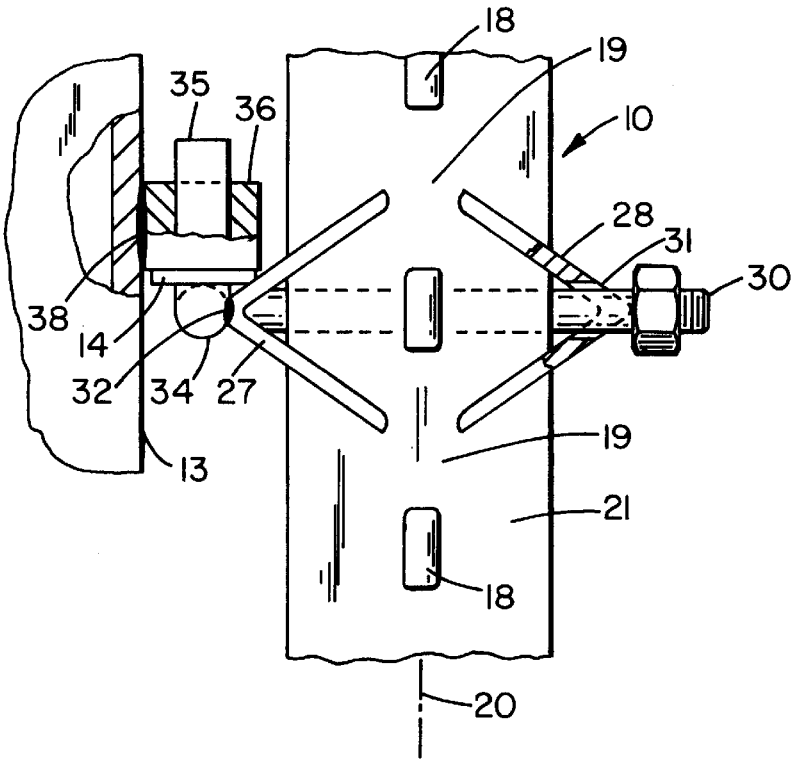
FIG. 3 is an elevational view taken in the direction of the arrow 3 in FIG. 2 of the engaged clamp bar and gate post with portions of the structure broken away for clarity.
Figure 19:
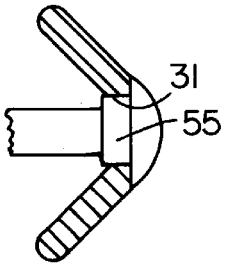
FIG. 19 is a cross-sectonal view of a portion of the bracketing means employing a non-rotating carriage bolt.

As shown in FIGS. 1, 2 and 3, at least two bracketing means each generally designated 26 rigidly couple the support members 10 and 11 together, and each 18 comprised of two angular clamping members 27 and 28, preferably of 1 to 3 inch angle iron having slots 29 cut into the sides thereof for receiving the lateral fins 16 of the support posts 10 and 11. A bolt 30 is mounted through a hole 31 thru the approximate center of each of the angular clamping members 27 and 28, as is shown in FIGS. 2 and 3 and provides the necessary clamping force to rigidly connect posts 10 and 11 together. As shown in FIG. 19, the bolt may be of the carriage bolt type and the hole 31 may be square or slotted such that the square shank 55 of the bolt will not turn in the hole, thus obviating the need for holding the bolt against rotation during assembly.

The horizontal portions 34 of the gate hinge pins 33 (FIGS. 1–3) are affixed preferably by welding as at 32 to clamping member 27 and extends outwardly and upwardly to provide vertical shafts 35 which are adapted for pivotal mounting in bearings 36 welded as at 38 to a vertical portion 13 of gate 24 to provide a swinging attachment of the gate 24. Portion 34 extends a sufficient distance from the clamping member 27 to allow an expansive opening capacity, e.g., a range of about 240° of the gate. A heavy washer 14 of metal or plastic may be provided to reduce friction between 34 and 36. Most fence gates utilize this general form of hinge pin and bearing arrangement, however in the event another type of hinge means is desired, such may be provided on the clamping member. In a preferred embodiment the lower hinge pin is turned upwardly such that the gate cannot easily be removed, i.e., without removing one of the brackets.

The third support member or post 12 is driven hard into the ground 22, e.g., 1.5 to 2.5 feet approximately in the fencing plane 25—25 (FIG. 1), at a stabilizing distance of, e.g., 3 to 6 feet outwardly from first support member 10. Post 12 is then bent back toward post 10 to an angle appropriate for the engagement of connector means 37 with post 10 with the latter maintained in its approximate vertical posture. This third support member or post 12 prevents the weight of the gate 24, particularly while closed, or the tension of the fencing, e.g., barb wire 65, where the double posts 10 and 11 are used to stabilize a terminating fence post, from pulling member 10 away from its vertical position. It is noted that the gate may be mounted on either of posts 10 or 11.

Figure 5:
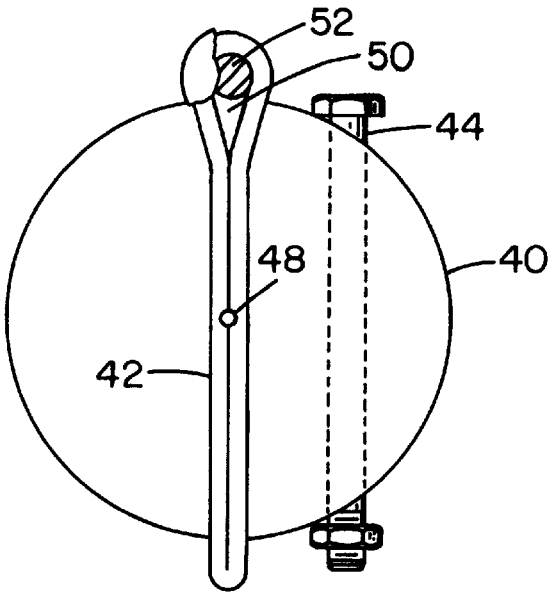
FIG. 5 is an elevational end view of the connector means taken in the general direction of arrow 5 in FIG. 4 with a portion of the nail head broken away for for clarity.
Figure 6:
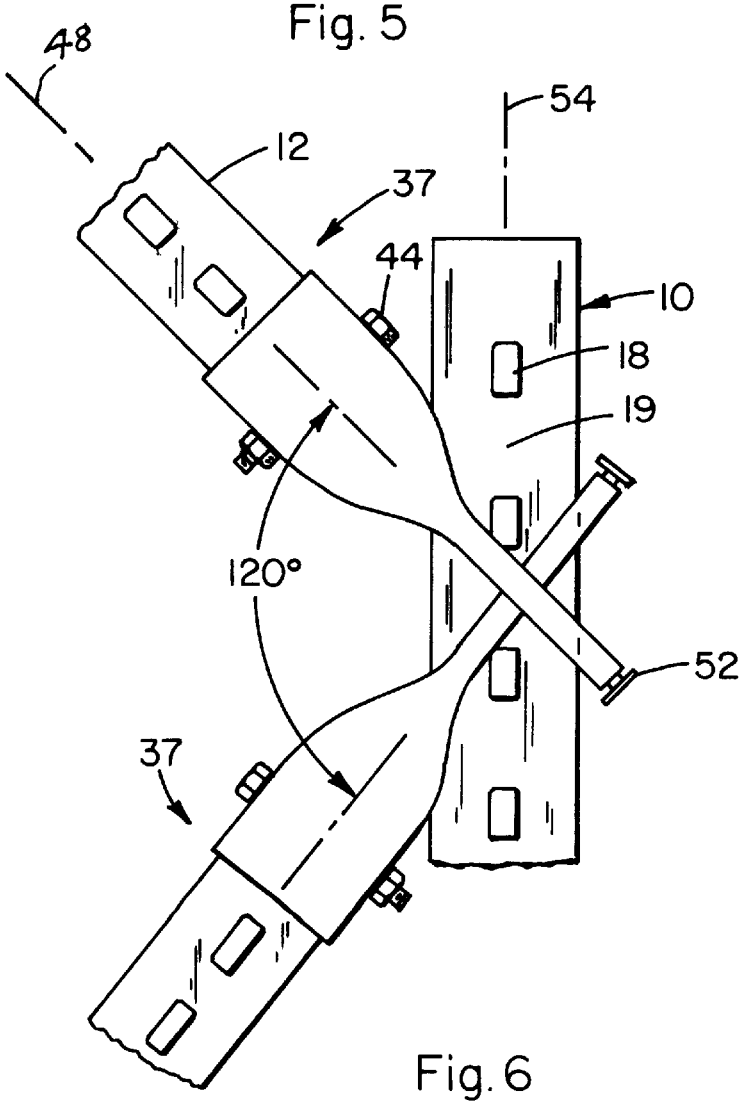
FIG. 6 is a side elevational view of the connector means exhibiting a range of positions allowable by the shape and dimensions of the hole thru the flattened end thereof for making easy the insertion of the post end therethrough.
Figure 7:
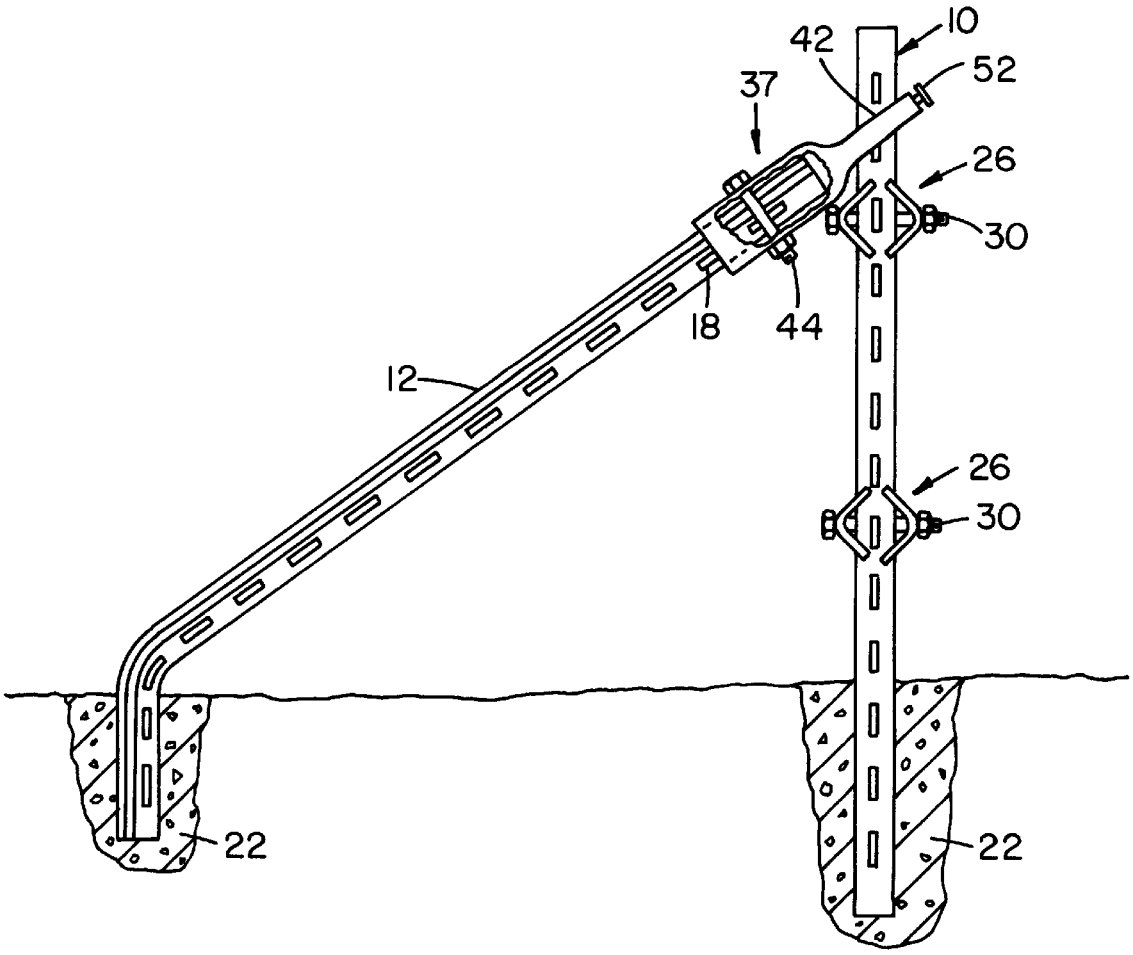
FIG. 7 is a side view of the present assembly in operating position taken generally in the direction of line 7 in FIG. 1.

Connector or adapter means 37 as shown particularly in FIGS. 4 and 5 is constructed preferably of rigid steel tubing having a tubular end 40 and a flattened end 42 and may be of any convenient length, e.g., 6 inches to 2 feet. End 40 is adapted to be adjustably connected to third support member 12 by way of a bolt 44 passing through apertures 46 in side portions of end 40 and within the space 19 between two post studs 18 thereby preventing any substantial sliding of post 12 within end 40. The other and 42 of the connector means is provided with a specially shaped and dimensioned hole 39 cut through the flattened lateral face 41 thereof such that the hole may slidably receive first post 10 at a range of angles relative to the longitudinal axis 48 of post 10, e.g., approximately from about 30° to about 80° in any direction to allow easy positioning of the third post 12 with respect to post 10. A substantially tubular slot 50 is formed axially in connector means 37 for slidably receiving a nail 52 or equivalent member to lie within and block a portion of a space 19 which prohibits the connector means 37 from sliding over the adjacent vertically spaced studs 18 on post 10, thereby, locking the connector means 37 and posts 10 and 12 in their operable positions as shown in FIGS. 1, 7 and 5.

It is noted that it 18 preferred to lock post 12 and connector means 37 in their final relative positions by means of bolt 44 only after end 42 of the connector means has been pushed down over post 12 to a desired bracing position wherein post 10 is substantially vertically oriented. In this regard, in one embodiment of the invention the tubular end 40 may be pre-fixed in permanent manner to post 12 whereby a more precise placement of post 12 in the ground is required to properly mate hole 39 with post 10, even though some leeway is inherent in such placement since 37 can be pushed down on post 10 until post 1018 substantially vertical and nail 52 then inserted to its locking position. In these aforedescribed embodiments some care should be exercised in bending post 12 such that hole 39 is substantially aligned with axis 54 of post 10 to allow end 42 to be readily pushed down over post 10. In a preferred embodiment of the invention which provides stabilizing unit for vertically stabilizing, in particular, an end or terminating fence post 23, or corner post, said unit as shown in FIG. 1 with respect to post 23 comprises a first element 12 and a second element 37, said post and first element each having an elongated configuration and a substantially planar back face 21, a plurality of stud means 18 projecting substantially normally from said back face and being spaced longitudinally thereon to provide a plurality of spaces 19 longitudinally spaced therebetween, said second element comprising a connector means 37 having a tubular end 40 and a flattened end 42, said tubular end receiving one end of said first element, said flattened end having an aperture means 39 therethrough, the other end of said first element being adapted to be driven into the ground at a distance of several feet from said post 23 generally along a fence line 25—25 and then bent to an angle appropriate to slide said aperture means 39 down over the top said post 23, first locking means 44 on said connector means 37 and adapted to engage between two of said stud means is on said first element 12 such that sald connector means cannot slide any substantial distance on said first element, and second locking means 52 on sald flattened end and adapted to engage between two of said stud means 18 on said post such that said connector means cannot slide any substantial distance up or down on said post.

Figure 10:
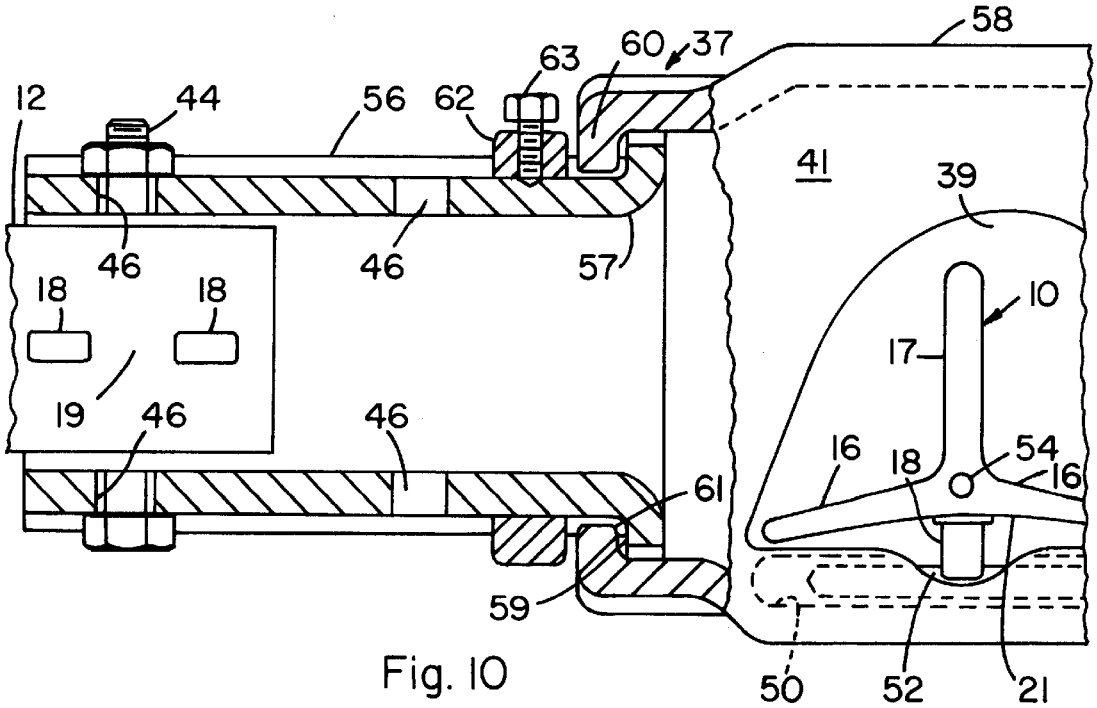
FIG. 10 is a view similar to FIG. 4 showing a highly preferred, longitudinally and angularly adjustable variation of the connector means.

Referring to FIG. 10 wherein thickness of the connector means parts are markedly exaggerated for clarity, the connector means 37 is comprised of first 56 and second 58 sections. Section 56 which is basically equivalent to end portion 40 is provided at its inner end 57 with an outwardly formed lip 59, preferably annular. Section 58 is basically equivalent to end portion 42 and the tubular inner end 60 thereof is provided with an inwardly formed lip 61, again preferably annular. Tubular ends 57 and 60 and lips 59 and 61 are all dimensioned such that sections 56 and 58 are readily angularly pivotal about each other while being restrained from pulling axially apart by engagement of lips 59 and 61. A heavy duty collar 62 affixed to section 56 by set screw 63 and spaced slightly from end 60 prevents any significant axial movement between the sections. In a preferred manufacture of this embodiment, the lips are first formed, the sections then assembled as shown and lock collar 62 affixed, and lastly the outer end of section 58 is flattened and apertured.

In this embodiment of FIG. 10, hole 39 can easily be aligned with axis 64 of post 10 regardless of which side of post 2 is bent toward post 10, and to this extent, this embodiment is highly preferred.

Figure 13:
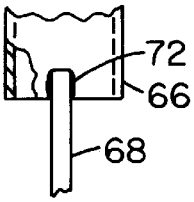
FIG. 13 is a view taken along line 13—13 in FIG. 12.
Figure 11:
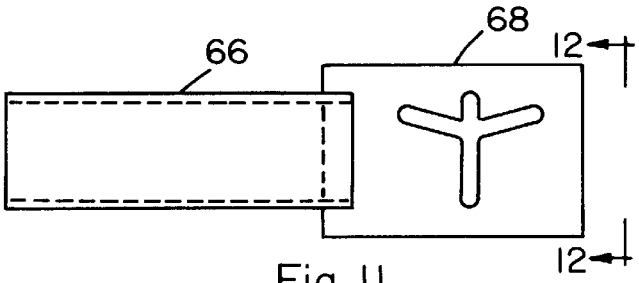
FIG. 11 is a top view of a variation in structure of the adapter means without any locking pin means.
Figure 12:
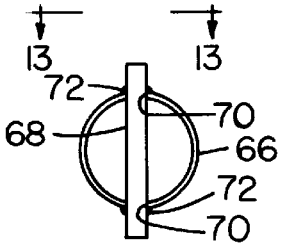
FIG. 12 is an end view of the adapter means of FIG. 11 taken in the direction of 12—12 in FIG. 11.
Figure 14:
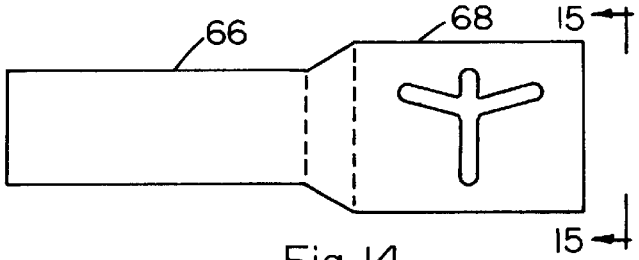
FIG. 14 is a view as in FIG. 11 of another variation of adapter structure also without any locking pin means.
Figure 15:
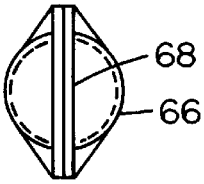
FIG. 15 is a view taken along line 15—15 in FIG. 14.

Referring to FIGS. 11–13 the adapter comprises an elongated member having a tubular distal section 66 and flat, plate like proximal section 68. Section 68 is a solid plate which is inserted into slots 70 in an end of section 66 and welded thereto as at 72. In FIGS. 14 and 15, the sections 66 and 68 are integrated. It is noted that in these embodiments no locking pin such as nail 50 is provided since the substantial tension on the fence wire will tightly retain the adapter on the bracing or third post 12.

Figure 16:
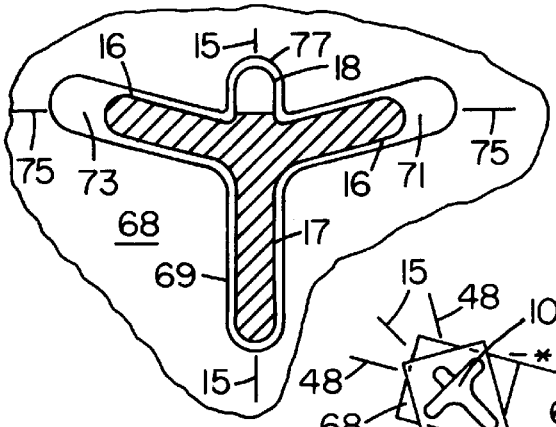
FIG. 16 is a lateral cross-sectional view of a post means inserted thru aperture means in the flattened end portion of an adapter means.
Figure 17:
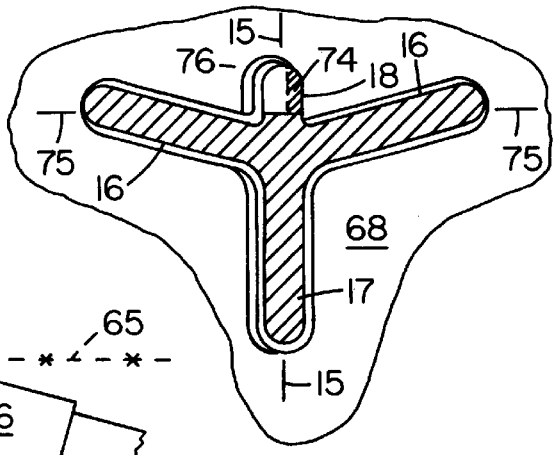
FIG. 17 is a view as in FIG. 16 with the adapter means rotated downwardly to position the cooperating lock shoulder means of the adapter means and the post means in an interfering relationship.
Figure 18:
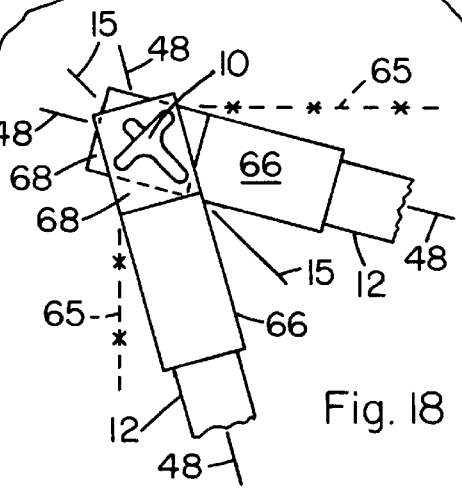
FIG. 18 is a top view of a post having two adapter means stacked thereon on each mounted on separate brace means for providing a highly stable corner post arrangement.

Referring to FIGS. 16 and 17 it is seen that as the adapter in FIG. 16 is rotated downwardly, i.e., counterclockwise thru the plane of the drawing sheet, the shaded surface portion 74 of section 68 of the adapter will move under a stud 18 and prevent upward movement of the adapter along the post in further elucidation of FIGS. 18 and 17, said aperture means generally designated 39 is formed in the shape of a cross-section of a common, studded, metal, generally T-shaped fence post, said aperture means having a front fin segment 69 oppositely extending lateral fin segments 71 and 73 and a stud segment 77, wherein all of said segments are oversized to allow an easy sliding fit of said one post means within said aperture means, and wherein an aperture segment dimension exists which is selected from the group consisting of (a) said lateral fin segments 71 and 73 are substantially longer than the corresponding fins of said one post means to allow said adapter means to rotate downwardly about a lateral spinal axis 15 of said one post means whereby said distal section 68 of sald adapter means can be readily sad over and mounted on the bent upper portion 67 of said brace means, or (b) sold front and stud segments 17 and 18 are substantially longer than the corresponding fins of said one post means to allow said adapter means to rotate downwardly about a lateral fin axis 75 of said one post means whereby said distal section of said adapter means can be readily slid over and mounted on the bent upper portion of said brace means, and whereby in each instance a forward portion 74, 76, i.e., shoulder means of said proximal section will thus be positioned under a stud, i.e., shoulder means to prevent inopportune movement of said adapter up or down on said post.

In the embodiment of FIG. 18, the aperture means 39 is angularly oriented differently in the two adapters such that they will fit over a single corner post 10 at different angles to the fence wire to provide improved stability. Such angular orientation of the aperture means can be tailored during manufacture to give a series of adapters for particular situations which may be encountered by the user, such as, e.g., right angle fence corners, or acute or obtuse angle corners, or ground obstructions such as large rocks.

The invention has been described in detail with particular reference to preferred embodiments thereof, but it will be understood that variations and modifications will be effected with the spirit and scope of the invention.

I claim:

1. A stabilizing unit for vertically stabilizing, in particular, an end or terminating fence post, or comer post, sold unit comprising a first element and a second element, said post and first element each having an elongated configuration, a substantially planar back face and a plurality of stud means projecting substantially normally from said back face and being spaced longitudinally thereon to provide a plurality of spaces longitudinally spaced therebetween, said second element comprising a connector means having a tubular end and a flattened end, said tubular end receiving one end of said first element, said flattened end having an aperture means therethrough, the other end of said first element being adapted to be driven into the ground at a distance of several feet from said post generally along a fence line and then bent to an angle appropriate to slide said aperture means down over the top of said post, first locking means on said connector means and adapted to engage between two of sold stud means on said first element such that said connector means cannot slide any substantial distance on said first element, and a second locking means on said flattened end and adapted to engage between two of said stud means on said post such that said connector means cannot slide any substantial distance up or down on said post.

2. The unit of claim 1 wherein said tubular end and flattened end are provided with a sliding interlocking flange means for allowing angular adjustment therebetween.

3. The unit of claim 1 wherein said tubular end and said first locking means are provided with cooperating bolt and hole means for providing position adjustment of said connector means longitudinally on said first element.

4. A fence terminating and gate support device comprising at least two post means each having a top end section and a bottom end section and adapted to be placed in a generally vertical orientation with respect to a ground surface, said bottom end section of each said post means being drivable or otherwise insertable a substantial distance into the ground such as to stabilize the post in the ground and prevent inopportune withdrawal therefrom, a elongated brace means having an upper portion and a lower portion, said lower portion being drivable into the ground and said upper portion being bendable toward a top end section of one of said post means, adapter means having a distal section and a proximal section, said distal section being mountable on said upper portion, said proximal section having aperture means formed generally laterally therethrough and adapted to slidably receive said one post means, cooperating lock shoulder means on said one post means and on said proximal section, said shoulder means becoming oriented to a lock position upon downward rotation of said adapter means on said one post means whereby movement of said adapter means on said one post means is limited to a prescribed extent, said post means being coupled to each other at upper and lower positions thereon by at least two bracket means, said bracket means having a gate hanging means affixed thereto for convenient hanging of gate means thereon.

5. The device of claim 4 wherein at least said one post means is comprised of a studded, metal, generally T-shaped cross-section fence post for supporting wire under substantial tension.

6. The device of claim 4 wherein said adapter means comprises an elongated member having a longitudinal axis, the distal section of which is tubular and adapted to slidably cap said upper portion of said brace means, and the proximal section of which is configured as a substantially flat plate which is provided with said aperture means formed laterally therethrough for slidably receiving the top end section of said one post means.

7. The device of claim 6 wherein said aperture means is formed in the shape of a cross-section of a common, studded, metal, generally T-shaped fence post, said aperture means having a front fin segment, oppositely extending lateral fin segments, and a stud segment, wherein all of said segments are oversized to allow an easy sliding fit of said one post means within said aperture means, and wherein an aperture segment dimension exists which is selected from the group consisting of (a) said lateral fin segments are substantially longer than the corresponding fins of said one post means to allow said adapter means to rotate downwardly about a lateral spinal axis of said one post means whereby said distal section of said adapter means can be readily slid over and mounted on the bent upper portion of said brace means, or (b) said front and stud segments are substantially longer than the corresponding fins of said one post means to allow said adapter means to rotate downwardly about a lateral fin axis of said one post means whereby said distal section of said adapter means can be readily slid over and mounted on the bent upper portion of said brace means, and whereby in each instance a forward portion of said proximal section will thus be positioned under a stud to prevent inopportune movement of said adapter up or down on said post.

8. A wire fence support device comprising at least one post means having a top end section and a bottom end section and adapted to be placed in a generally vertical orientation with respect to a ground surface, said bottom end section of said post means being drivable or otherwise insertable a substantial distance into the ground such as to stabilize the post in the ground and prevent inopportune withdrawal therefrom, an elongated brace means having an upper portion and a lower portion, said lower portion being drivable into the ground and said upper portion being bendable toward a top end section of one of said post means, adapter means having a distal section and a proximal section, said distal section being mountable on said upper portion, said proximal section having an aperture means formed generally laterally therethrough and adapted to slidably receive said one post means, cooperating lock shoulder means on said one post means and on said proximal section, said shoulder means becoming oriented to a lock position upon downward rotation of said adapter means on said one post means whereby movement of sold adapter means on said one post means is limited to a prescribed extent.

9. The device of claim 8 wherein at least said one post means is comprised of a studded, metal, generally T-shaped cross-section fence post for supporting wire under substantial tension.

10. The device of claim 8 wherein said adapter means comprises an elongated member having a longitudinal axis, the distal section of which is tubular and adapted to slidably cap said upper portion of said brace means, and the proximal section of which is configured as a substantially flat plate, which is provided with said aperture means formed laterally therethrough for slidably receiving the top end section of said one post means.

11. The device of claim 10 wherein said aperture means is formed in the shape of a cross-section of a studed, metal, generally T-shaped cross-section fence post, said aperture means having a front fin segment, oppositely extending lateral fin segments, and a stud segment, wherein all of said segments are oversized to allow an easy sliding fit of said one post means within said aperture means, and wherein said lateral fin segments of said aperture means are substantially longer than the lateral fins of said post means to allow sald adapter means to rotate downwardly about a lateral spinal axis of said post means whereby said distal section of said adapter means can be readily slid over the bent upper portion of said brace means.

12. An adapter means for attaching a studded, metal, generally T-shaped cross-section fence post to an elongated brace means, said adapter means comprising an elongated member having a longitudinal axis, a distal section of which member is tubular and adapted to slidably cap an upper portion of said brace means, and a proximal section of which member is configured as a substantially flat plate which is provided with an aperture means formed laterally therethrough for slidably receiving a top and section of said fence post, said aperture means having a front fin segment, oppositely extending lateral fin segments, and a stud segment, wherein all of said segments are oversized to allow an easy sliding fit of said one post means within said aperture means.

13. The adapter means of claim 12 wherein said lateral fin segments of said aperture means are substantially longer than the lateral fins of said post means to allow said adapter means to rotate downwardly about a lateral spinal axis of said post means whereby said distal section of said adapter means can be readily slid over the bent upper portion of said brace means.

14. The device of claim 4 wherein said gate hanging means comprises a downwardly extending hinge pin affixed to a first bracket means located at a said upper position, and an upwardly extending hinge pin affixed to a second bracket means located at a said lower position, whereby said brackets can be assembled one at a time to said post means and said pins thus inserted one at a time in hinge sockets affixed to a gate, thereby affording on element of security against untoward removal of the gate.

15. A fence terminating and gate support device comprising first and second support means each having a generally vertical orientation with respect to a ground surface, an end portion of each said first and second support means being driven or otherwise inserted a substantial distance into the ground such as to prevent easy withdrawal therefrom, third support means having an upper end, a lower end and an intermediate section therebetween and having a generally diagonal orientation with respect to ground surface, said lower end of said third support means being driven into said ground and said intermediate section being bent toward a top portion of one of said support means where it is connected thereto by a post end adapter means, said first support means being coupled to said second support means by a plurality of bracketing means, said bracketing means having gate hinge pin means affixed thereto adjacent top and bottom portions of said first and second support means for convenient attachment of gate means thereto, said first, second and third support means each being comprised of metal T-shaped cross-section fence posts, wherein said post end adapter means comprises tubular wall means having a longitudinal axis and one end of which slidably caps said upper end of said third support means, and the other end of which is substantially flattened and provided with a hole formed laterally therethrough for slidably receiving an upper end of said first or second support means, and wherein locking means is provided on said post end adapter means for preventing said adapter means from disengaging from said one of said first or second support means, said locking means comprising a sleeve means which is generally longitudinally provided in a side portion of said adapter means and which sleeve means slidably receives a locking pin means which blocks a portion of said hole, which hole, when unblocked, allows said adapter means to slide over substantially vertically spaced studs on said one of said first or second support means, but which, when blocked by said pin means, locks said adapter means into a position between two of said substantially vertically spaced studs.

16. A fence terminating and gate support device comprising first and second support means having a generally vertical orientation with respect to a ground surface, an end portion of each said first and second support means being driven or otherwise inserted a substantial distance into the ground such as to prevent easy withdrawal therefrom, third support means having an upper end, a lower end and as intermediate portion therebetween and having a generally diagonal orientation with respect to ground surface, said lower end of said third support means being driven into said ground and said intermediate portion being bent toward a top portion of said first support means where it is connected thereto by a post end adapter means, said first support means being coupled to said second support means by a plurality of bracketing means, said bracketing means having gate hinge pin means affixed thereto at top and bottom portions of said first and second support means for convenient attachment of gate means thereto, wherein said bracketing means comprises two angle iron clamping members having slots cut laterally into the sides thereof for receiving laterally projecting fins on said first and second support means, said clamping members having at least one bolt for providing a clamping force on said first and second support means for rigidly maintaining them in their spaced positions.

17. A fence terminating and gate support device comprising first and second support means having a generally vertical orientation with respect to a ground surface, an end portion of each said first and second support means being driven or otherwise inserted a substantial distance into the ground such as to prevent easy withdrawal therefrom, third support means having an upper end, a lower end and as intermediate portion therebetween and having a generally diagonal orientation with respect to ground surface, said lower end of said third support means being driven into said ground and said intermediate portion being bent toward a top portion of said first support means where it is connected thereto by a post end adapter means, said first support means being coupled to said second support means by a plurality of bracketing means, said bracketing means having gate hinge pin means affixed thereto at top and bottom portions of said first and second support means for convenient attachment of gate means thereto, said first, second, and third support means each being comprised of metal, T-shaped fence posts, wherein said post end adapter means comprises tubular wall means having a longitudinal axis, one end of which slidably caps said upper end of said third support means, and the other end of which is substantially flattened and provided with a hole laterally therethrough for slidably receiving an upper end of said first support means, wherein length adjustment means is provided on said adapter means for engagement with said studs of said third support means whereby lengthening or shortening the length of said third support means between its lower end and an upper end of said first support member can be attained even though the distance between said lower end and a lower end of said first support means is not accurately measured beforehand,and wherein said adjustment means comprises aperture means through said wall means providing a lateral axis adapted to pass between said studs, and removable bolt means inserted through said aperture means along said lateral axis and adapted to lie between and engage adjacent studs to prevent significant relative movement of said adapter means along said third support means.

18. A fence terminating and gate support device comprising first and second support means each having a top end portion, a lower end portion, a mid portion and a generally overall vertical orientation with respect to a ground surface, each lower end portion of each said first and second support means being driven or otherwise inserted a substantial distance into ground soil such as to provide lateral stability to the support means and prevent easy withdrawal from the soil, third support means having an upper end section, a lower end section and an intermediate section therebetween, said intermediate section having a generally diagonal orientation with respect to ground surface, said lower end section of said third support means being driven into said soil and said intermediate section being bent toward said top end portion of said first support means where it is connected thereto by a post end adapter means, said first support means being coupled to said second support means by a plurality of bracketing means, said bracketing means having gate hinge pin means affixed thereto at vertically spaced upper and lower segments of said first and second support means for convenient attachment of gate means thereto, said first, second, and third support means each being comprised of metal T-shaped cross-section fence posts, wherein said post end adapter means comprises tubular wall means having a longitudinal axis and one end of which slidably caps the upper end of said third support means and the other end of which is substantially flattened and provided with a hole laterally therethrough for slidably receiving the top end portion of one of said first or second support means, wherein length adjustment means is provided on said adapter means for engagement with longitudinally spaced studs on said third support means whereby lengthening or shortening the combined overall length of said third support means and said adapter means can be attained even though the distance between said lower end section of said third support means and said top end portion of said one of said first or second support means is not accurately measured beforehand.

* * * * *